US005820414A

United States Patent [19]

Omori

[11] Patent Number: 5,820,414

[45] **Date of Patent: *Oct. 13, 1998**

[54] IC CARD ADAPTOR AND CONSTRUCTION OF CONNECTING PORTION BETWEEN ADAPTOR AND IC CARD

[75] Inventor: Makoto Omori, Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 662,470

[22] Filed: Jun. 13, 1996

[30] Foreign Application Priority Data

Dec. 19, 1995 [JP] Japan ..... 7-330342

[51] Int. Cl.[6] ..... H01R 25/00

[52] U.S. Cl. ..... 439/638; 439/946

[58] Field of Search ..... 439/76.1, 638, 439/946, 946.2

[56] References Cited

U.S. PATENT DOCUMENTS 5,207,586 5/1993 MacGregor et al. ..... 439/76.1

5,457,601 10/1995 Gorgopulos et al. ..... 439/946

FOREIGN PATENT DOCUMENTS 0657834 6/1995 European Pat. Off. .

5250078 9/1993 Japan .

6176813 6/1994 Japan .

6215389 8/1994 Japan .

*Primary Examiner*—P. Austin Bradley

*Assistant Examiner*—T. C. Patel

[57] ABSTRACT

An IC card adaptor which allows expansion or improvement of the functions of the IC card inexpensively is provided. The IC card adaptor is to be connected with the IC card, in which the IC card is provided with a main-connector for connecting with prescribed electronic equipment on one side and is provided with sub-connectors for connecting with an adaptor on another side. The adaptor is provided with primary connectors to be connected to the sub-connectors of the IC card, a secondary connector to be connected with another piece of electronic equipment or a telecommunication line, and an electric circuit board on which prescribed electronic components are mounted. Both connectors are connected to each other and an adaptor module is constituted on the electric circuit board. The adaptor module is provided with another prescribed function, such as a telephone set, different from functions the IC card primarily possesses.

3 Claims, 10 Drawing Sheets

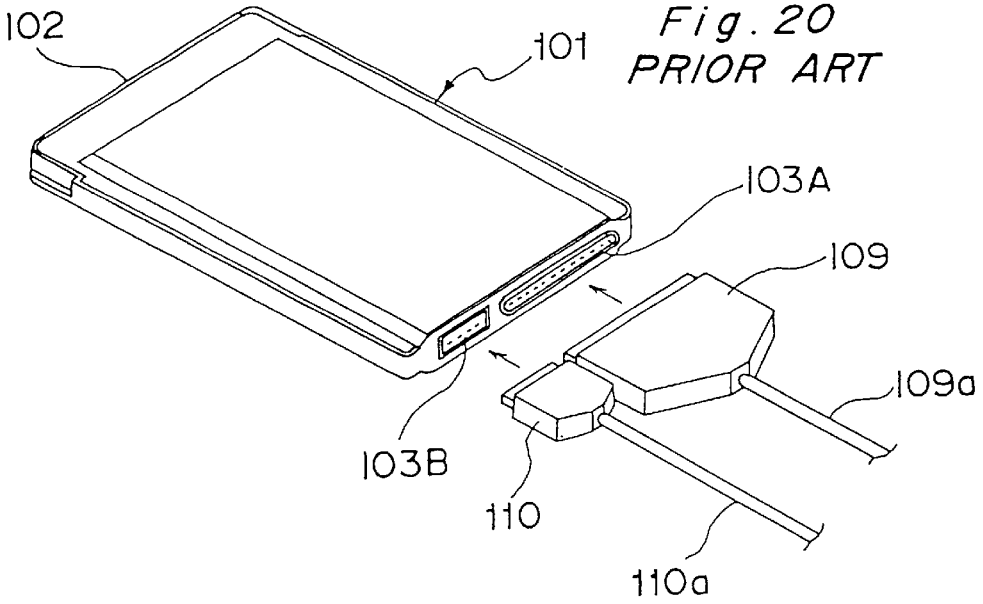
Fig. 20 PRIOR ART
Fig. 21 PRIOR ART
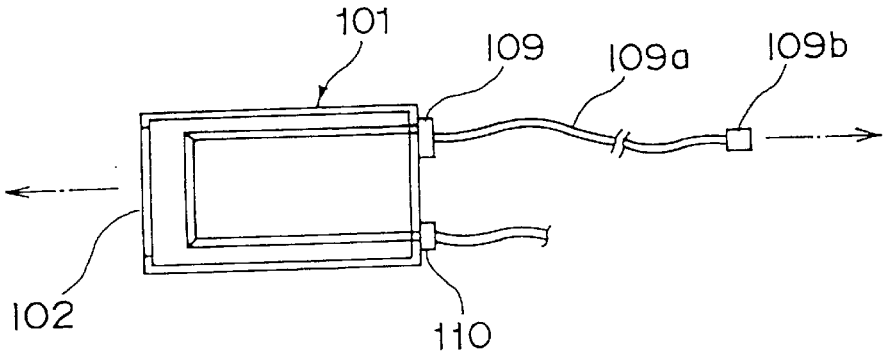
Fig. 22 PRIOR ART
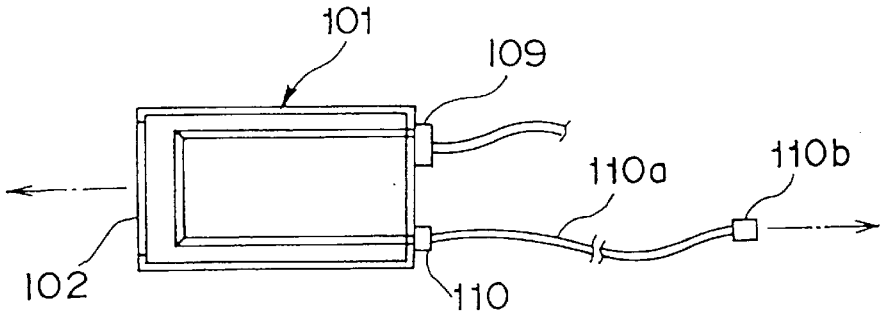

IC CARD ADAPTOR AND CONSTRUCTION OF CONNECTING PORTION BETWEEN ADAPTOR AND IC CARD

FIELD OF THE INVENTION

The present invention relates to an IC card adaptor to be connected with an IC card and a construction of connecting portion between the adaptor and the IC card.

DESCRIPTION OF THE PRIOR ART

As widely known, recently, in electronic equipment, for example, computer devices such as personal computers and work stations etc., IC card have commonly been utilized, not only for the purpose of increasing memory capacity but also, for example, for telecommunicating between computer devices or between computer devices and outer public circuits etc.

In the specification, the term "IC card" indicates a card-like or plate-like device being provided with electronic circuits including semiconductor circuits or electric circuits, and cards provided with the same basic constitution, being called for example, PC card, modem card, LAN card or electronic card etc.

In such cards, for example, in the case of a card being provided with what we call modem function, a secondary connector (sub-connector) for interfacing with other electronic equipment or telecommunication lines such as public circuits is provided, in addition to a primary connector (main-connector) for connecting with a body of an electronic equipment, and a sub-connector and other electronic equipment or telecommunication line are connected through an adaptor or a connector with a cable. This adaptor or a connector with a cable are, therefore, provided with a primary connector to be connected with the sub-connector of the IC card and a secondary connector to be connected with another piece of electronic equipment or a telecommunication line.

For example, in Japanese patent Laid-open Publication No. Hei 6-176813 or Hei 6-215839, an adaptor being provided with a connector for connecting with an IC card and a connector to be connected with a modular-jack for interfacing with a telephone line etc. is disclosed. Further, in Japanese patent Laid-open Publication No. Hei 5-250078, an IC card of which the sub-connector is to be connected with a connector with a cable.

In the case of providing a card with a plurality of functions (for example, a telecommunication function with a public circuit and a telecommunication function with portable telephone sets etc.), a plurality of sub-connectors corresponding to each function respectively are provided to the IC card, and adaptors corresponding to each function are connected with appropriate sub-connectors respectively.

Now, the construction of the above-mentioned IC card provided with the main and sub connectors will be explained, in the case of an IC card having a plurality of sub-connectors.

That is to say, in such a card, as shown in FIG. 16, FIG. 17 and FIG. 18, a main-connector 102 is provided on a side of the body, and, for example two sub-connectors 103A, 103B are provided on a reverse side. The main-connector is for obtaining an electrical connection with an equipment in which the IC card 101 is used, for example, a personal computer etc. On the other hand, the sub-connectors 103A, 103B are for obtaining an electrical connection with an outer public circuit or a portable telephone.

An obverse and reverse of a plane portion of the IC card 101 are covered with a pair of metal panels 104 respectively, and, by these metal panels 104, electronic components integrated in the body of the IC card 101 are electrically protected from static electricity impressed from outside.

The IC card has, as shown in FIG. 19, a frame 105 made of plastic which forms an outer shape of card body, and an electric circuit board 106 where prescribed electronic components etc.107 including semiconductor circuits are incorporated, and the main-connector 102 and the sub-connectors 103A, 103B are mounted at a front end portion and a rear end portion of electric circuit board 106 respectively. These connectors 102, 103A, 103B and the electronic components etc.107 are electrically and mechanically connected to the electric circuit board 106, for example, by soldering. In the specification, a unit of the electric circuit board 106 mounted with the electronic components etc. 107 and each connector 102, 103A, 103B in such a way, is named IC card module 108.

An IC card is assembled as one body, by burying the IC card module 108 inside of the plastic frame 105, and fixing the metal panels 104 to the obverse and reverse of the frame 105 by using an adhesive etc.

The IC card module 108 has, for example, a couple of functions, that is to say, a telecommunication function with outer public circuits and a telecommunication function with portable telephones, and the sub-connectors 103A, 103B respectively correspond to the telecommunication with public circuits and the telecommunication with the portable telephones.

In FIG. 20, IC card connectors 109 and 110 with cables, which are to be used by connecting to an IC card 101 are shown, and these connectors 109 and 110 are respectively to be used for telecommunication with the public circuits and for telecommunication with the portable telephones.

And, in data communication using the public circuits, as shown in FIG. 21, the connector 109 with a cable is connected to the sub-connector 103A, while a connector 109*b* provided at another end of the cable 109*a* of said connector 109 is connected to a public circuit. Formerly, even if a plurality of functions are provided to the IC card, it was impossible to utilize these functions at the same time. Accordingly, in such a case, the connector 103B for telecommunication with portable telephones and the connector 110 with a cable cannot to be used.

Also, in data communication using portable telephones, as shown in FIG. 22, the connector 110 with a cable is connected to the sub-connector 103B, while a connector 110b provided at another end of the cable 110*a* of connector 110 is connected to the portable telephones. In this condition, the connector 103A for telecommunication with public circuits and the connector 109 with a cable cannot to be used.

Thus, in the above-mentioned example, two functions (a telecommunication function with public circuits and a telecommunication function with portable telephones) provided to the IC card can not be utilized the same time, but, for example, by incorporating a telephone function itself to the IC card module 108, it becomes possible to utilize both functions at a time.

However, formerly, in aiming at expanding or improving the functions of the IC card, since the IC card module 108 itself must be changed, the user must purchase additionally an other IC card whose card module has been changed.

Because applications of IC cards are being enlarged and developed, it is strongly desired to restrain costs, as much as possible, when expanding or improving the functions of the IC cards.

Also, in the body of an electronic device in which an IC card is applied, wherein a sub-connector of the IC card can be connected with an adaptor, sometimes a plurality of card slots are provided.

In such a case, if the thickness the adaptors is greater than the thickness of the IC card, when inserting each IC card into the corresponding card slot, connecting the adapters to each IC card respectively, both adapters interrupt each other, and this impedes connecting.

Also, formerly, when an adaptor is connected to an IC card, as shown in FIG. 23, if the adaptor 129 is subject to an external force in an upper and lower direction in this connected state, a moment load acts directly on the connecting portion 128 between the adaptor 129 and the IC card 121, and the reliability of the contact between the connectors may be lowered.

Further, as concerning to a construction of a connecting portion between an IC card and an adaptor, formerly, as shown in FIG. 24, a sub-connector 133A (a female type connector) of an IC card 131 is generally mounted at an end of an electric circuit board 136, so that its end face essentially aligns with the same plane as an end face of the card 131 (i.e. at an end face of plastic case 135). On the other hand, a connector 142A (a male type connector) of an adaptor 141 is mounted to the board 146, so that it protrudes by a predetermined length from an end of adaptor case 145. And, when both connector 133A, 142A are connected to each other, the connecting portion is exposed directly to the outside through a very small clearance 140 formed between the end portion of the IC card 131 and the end portion of the adaptor 141.

Accordingly, there is a problem that, outside static electricity is impressed to the connecting portion of both connector 133A, 142A through the clearance 140, and, there is the possibility of negatively affecting the inner electronic components of the IC card 131 and the adaptor 141.

SUMMARY OF THE INVENTION

The present invention has been developed to solve the above-mentioned conventional problems, and has an object of providing an adaptor, which allows expansion or improvement of the functions of the IC card inexpensively. Also, the invention has another object of providing an adaptor, which is able to be connected without trouble to each IC card being inserted into a plurality of card slots respectively. Further, the invention has an object of providing an adaptor, which makes it possible to reduce the effect on the connecting portion when it is subjected to an external force when connected to the IC card. Furthermore, the invention has another object of providing a connecting construction between an adaptor and an IC card, which makes it possible to protect the connecting portion effectively against outside static electricity.

Thus, according to an aspect of the present invention which is developed to achieve the above-mentioned objects, there is provided an IC card adaptor to be connected with an IC card, in which the IC card is provided with a main-connector for connecting with a prescribed electronic equipment on a side and is provided with sub-connector for connecting with an adaptor on another side, including; a primary connector to be connected to the sub-connecting of the IC card; secondary connector to be connected with an other electronic equipment or a telecommunication line; and an electric circuit board on which prescribed electronic components etc. are mounted; and, wherein both connector are connected to each other and an adaptor module is constituted on the electric circuit board, the adaptor module is provided with prescribed functions different from the primary functions of the IC card.

In the above-mentioned IC card adaptor according to the aspect of the invention, it has the adaptor module constituted by connecting both of the primary and the secondary connectors to the electric circuit board incorporated with the prescribed electronic components etc., and the adaptor module has another prescribed function different from the function of the IC card, by connecting the primary connector to the sub-connector of the IC card, it is possible to add another prescribed function which the IC card does not have primarily to the IC card.

Accordingly, in adding another prescribed function to the functions which the IC card has possessed primarily, the users need not to purchase a new IC card incorporated with all of those functions, and can to expand or improve the functions of the IC card only by purchasing a relatively inexpensive adaptor.

Further, in the above-mentioned IC card adaptor, it is preferable that a thickness of the IC card adaptor is determined to be equal or less than a maximum thickness of the IC card.

In this case, since the thickness of the IC card adaptor is determined to be equal or less than a maximum thickness of the IC card, in the case that a plurality of card slots are provided on the body of the electronic equipment to be mounted with the IC card, it is possible to connect the adapters to the IC cards inserted into the plurality of the card slots respectively, without interfering with each other.

Accordingly, in the case that each adaptor is to add another function to the IC card, it is possible to use the IC card receiver provided with a plurality of card slots formed conventionally in the electronic equipment, and to expand the functions of the IC card system inexpensively.

Still further, according to another aspect of the present invention, there is provided an IC card adaptor to be connected with an IC card, in which the IC card is provided with main-connector for connecting with a prescribed electronic equipment on a side and is provided with a sub-connector for connecting with an adaptor on another side, wherein; a pair of upper and lower cover portions are provided in an adaptor case which forms an outer shape of the adaptor, the cover portion being formed by expanding prescribed parts on a side to be connected with the sub-connector of the IC card in a connecting direction, and when the adaptor is connected to the IC card, the cover portions fit with predetermined portions of the IC card by sandwiching it from upper and lower sides.

In this case, when an external force acts on the adaptor in an upper and lower direction in a condition of being connected to the IC card, a moment load caused by the external force is endured by the fitting portions between the cover portions of the adaptor and the predetermined portions of the IC card, and, it does not act directly on the connecting portion between the connector of the adaptor and the IC card. Therefore, possible problems such as a poor contact between the connections can be restrained.

In other words, even if an external force acts on the adaptor in an upper and lower direction in the condition of being connected to the IC card, the influence on the connecting portion between the connector of the adaptor and the IC card can be reduced, and, the reliability of IC card system when it is used by connectors both connecting each other can be further improved.

Furthermore, according to another aspect of the present invention, there is provided a construction of a connecting portion between an IC card adaptor and an IC card, in which the IC card adaptor is to be connected with the IC card, and the IC card is provided with a main-connector for connecting with a prescribed electronic equipment on a side and is provided with a sub-connector for connecting with the adaptor on another side, wherein; the sub-connector of the IC card is positioned inside of an end portion of metal panels covering an upper and lower side of the IC card, while the IC card adaptor is designed so that a thickness of at least a predetermined end portion which includes an connector to be connected with the sub-connector is to be smaller than a distance between the upper and lower metal panels, and, when the adaptor is connected to the IC card, the connecting portion between the sub-connector of the IC card and the connector of the adaptor is positioned inside of an end portion of metal panels of the IC card.

In this case, when the adaptor is connected to the IC card, the connecting portion between the sub-connector of the IC card and the connector of the adaptor is positioned inside of an end portion of metal panels of the IC card, therefore, the connecting portion is not exposed directly to the outside through the clearance between the end portion of the IC card and the end portion of the adaptor.

In other words, the connecting portion between the sub-connector of the IC card and the connector of the adaptor can be protected effectively, and, reliability of IC card system when it is used by connecting both connector to each other can be elevated still higher.

BRIEF DESCRIPTION OF THE DRAWINGS

These and other objects, features and advantages of the present invention will become clear from the following description taken in conjunction with the preferred embodiment with reference to the accompanying drawings, and in which:

FIG. 20 is a perspective view of the conventional IC card and the conventional IC card connector with a cable;

FIG. 21 is a plan view illustrates an example of the connecting condition of the conventional IC card and the connector with a cable;

FIG. 22 is a plan view illustrates another example of the connecting condition of the conventional IC card and the connector with a cable;

DETAILED DESCRIPTION OF THE PREFERRED EMBODIMENT

Hereinafter, preferred embodiments of the present invention will be explained in detail with reference to attached drawings.

At first, a first embodiment of the invention shown in FIG. 1–FIG. 7 will be explained.

Figure 1:
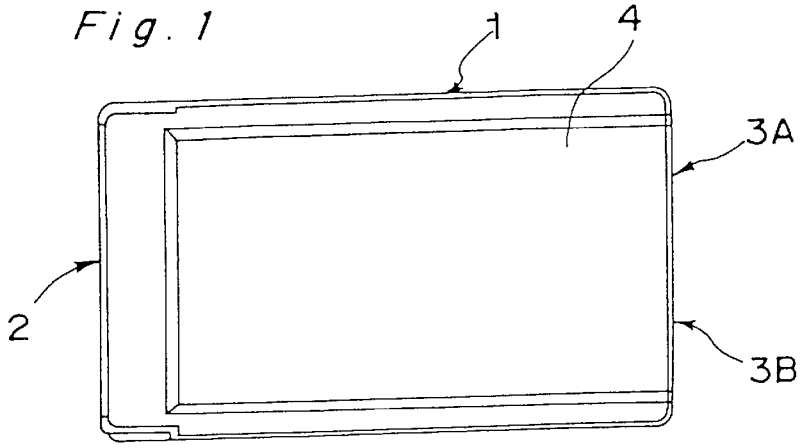
FIG. 1 is a plan view of the IC card in a first embodiment of the present invention.
Figure 2:
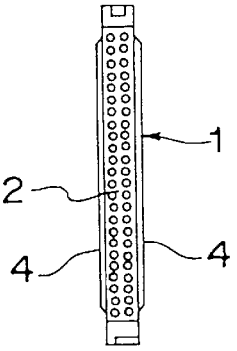
FIG. 2 is a side view illustrates the main-connector of the IC card in the first embodiment of the present invention.
Figure 3:
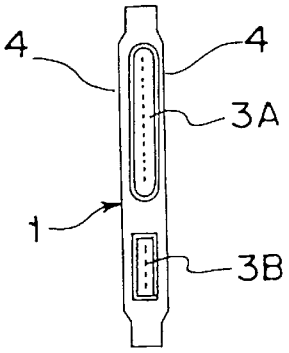
FIG. 3 is a side view illustrates the sub-connector of the IC card in the first embodiment of the present invention.

In an IC card 1 of this embodiment, as shown in FIG. 1, FIG. 2 and FIG. 3, a main-connector 2 is provided on a side of body, while a plurality of (a couple of; in this embodiment) sub-connectors 3A, 3B are provided on the reverse side.

Main-connector 2 is for obtaining an electrical connection with an equipment(e.g. a personal computer) in which the IC card 1 is used, on the other hand, sub-connectors 3A, 3B are for obtaining electrical connections with adapters which will be mentioned later.

An obverse and reverse of a plane portion of the IC card 1 are covered with a pair of metal panels 4 respectively, and, by these metal panels 4, the electronic components integrated in the body of the IC card 1 are electrically protected from static electricity impressed from out side.

Figure 4:
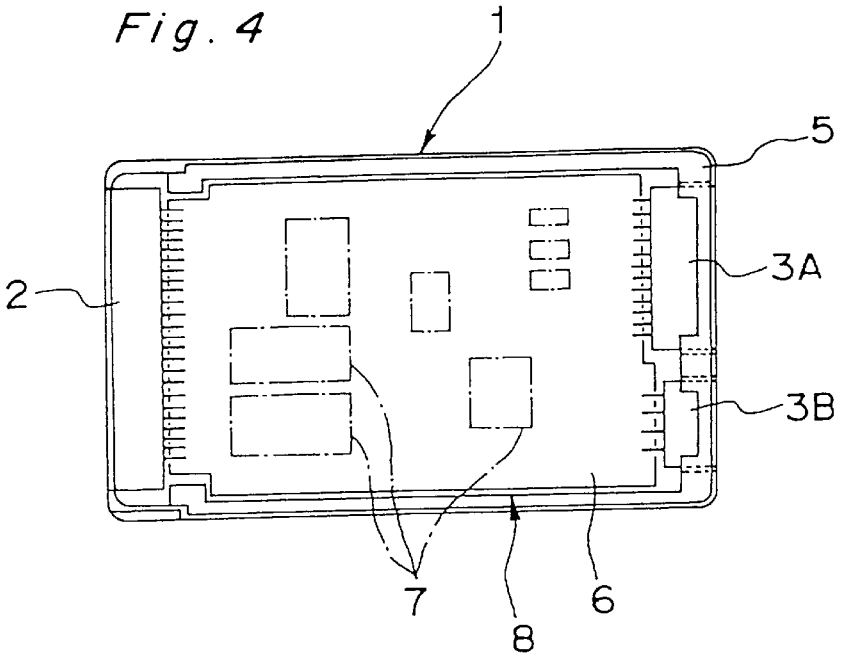
FIG. 4 is a plan view illustrates the inner construction of the IC card of the first embodiment of the present invention.

FIG. 4 is a plan view which illustrates an inner construction of the IC card 1. As shown in this figure, this IC card 1 includes a frame 5 made of plastic which forms an outer shape of a card body, and an electric circuit board 6 on which prescribed electronic components etc. 7 including semiconductor circuits are incorporated, and, the main-connector 2 and the sub-connectors 3A, 3B are mounted at a front end portion and a rear end portion of said electric circuit board 6 respectively.

These connectors 2, 3A, 3B and the electronic components etc.7 are electrically and mechanically connected to the electric circuit board 6, for example, by soldering.

In the specification, a unit of the electric circuit board 6 mounted with the electronic components etc.7 and each connector 2, 3A, 3B in such a way, is named IC card module 8. In this embodiment, the IC card module 8 has, for example, a couple of functions, that is to say, a telecommunication function with outer public circuits and a telecommunication function with portable telephones, and, the sub-connectors 3A, 3B respectively corresponding to the telecommunication with the public circuits and the telecommunication with the portable telephones.

The IC card 1 is assembled as one body, by burying the IC card module 8 inside of the plastic frame 5, and fixing the metal panels 4 to the obverse and reverse of the frame 5 by using an adhesive etc.

Figure 5:
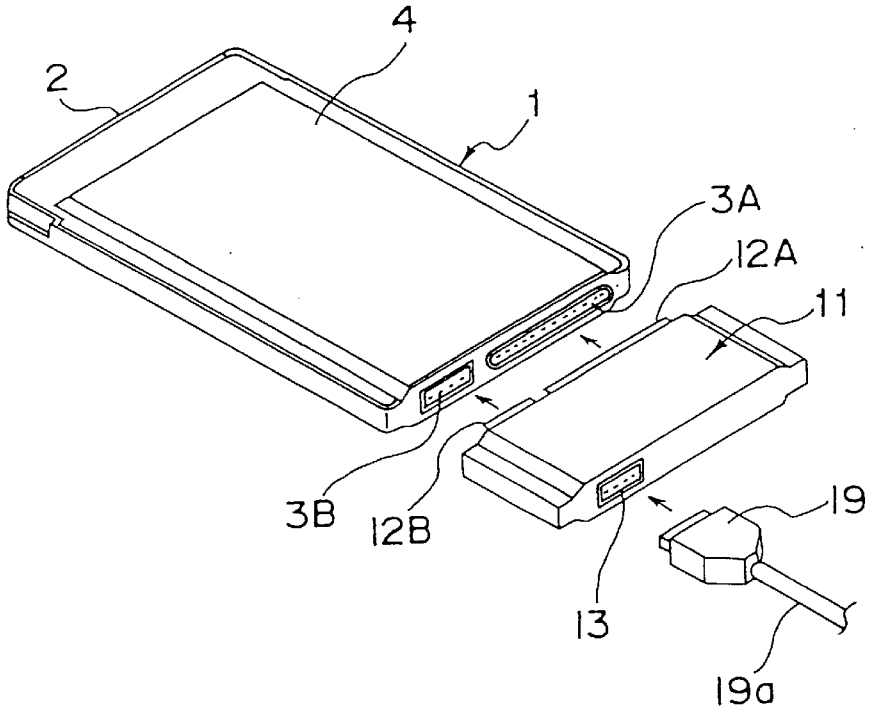
FIG. 5 is a perspective view of the IC card and the IC card adaptor in the first embodiment of the present invention.

In FIG. 5, an IC card adaptor 11 to be used by connecting to the IC card 1 is shown. A plurality of(for example two; in this embodiment) adaptor-side main-connectors 12A, 12B (primary connectors) to be respectively coupled with the sub-connectors 3A, 3B of the IC card 1 are provided on a side of said adaptor 11, on the other hand, one or a plurality of(for example one; in this embodiment) adaptor-side sub-connectors 13 are provided on the reverse side.

To this adaptor-side sub-connector 13, for example, a connector 19 with a cable is connected, and at another end of the cable 19*a* of the connector 19, for example, a connector (not shown) to be connected electrically to a telephone circuit is provided.

Figure 6:
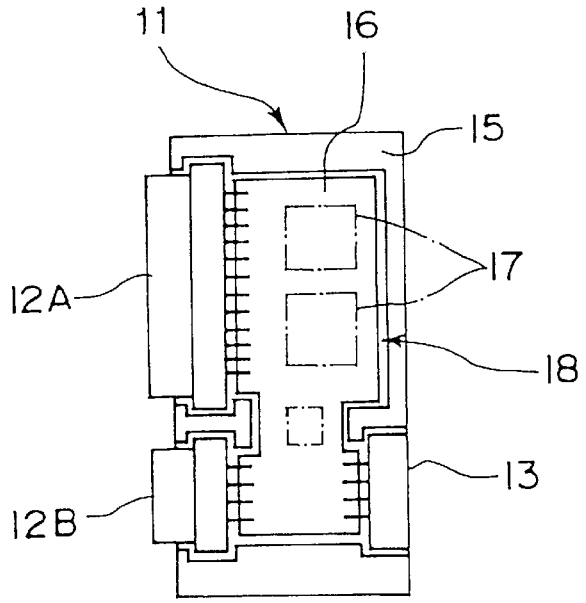
FIG. 6 is a plan view illustrates the inner construction of the IC card adaptor in the first embodiment of the invention.

Further, FIG. 6 is a plan view illustrates an inner construction of the IC card adaptor 11. As shown in this figure, the IC card adaptor 11 includes a frame 15 made of plastic which forms an outer shape of an adaptor body, and an electric circuit board 16 on which prescribed electronic components 17 including semiconductor circuits are incorporated, and, the main-connectors 12A, 12B and the sub-connector 13 are mounted at a primary end portion and a secondary end portion of said electric circuit board 16 respectively.

These connectors 12A, 12B, 13 and the electronic components 17 are electrically connected to electric circuits on the electric circuit board 16, for example, by soldering.

In the specification, a unit of the electric circuit board 16 mounted with the electronic components etc.17 and each connector 12A, 12B, 13 in such a way, is named adaptor module 18. By connecting the adaptor 11 to the IC card 1 after mounting the IC card 1 to a personal computer for example, each electric circuit or electronic circuit on the adaptor module 18 is driven by electric power supplied from the personal computer through the IC card 1. Alternatively, the adaptor may have its own battery, by enabling the adaptor 11 to be mounted with a thin battery such as a lithium battery.

The plastic case 15 is formed, for example, by being divided into two parts of the upper half and the lower half, and, after burying the adaptor module 18 into a case half 15, stacking the other case half (not shown) on that, and by fixing them to each other with an adhesive etc., the IC card adaptor 11 is assembled as one body.

In this embodiment, the IC card adaptor 11 is not merely a connecting appliance for obtaining an electrical connection between the IC card 1 and other device, equipment or telecommunication line etc., and it is constituted, by being connected with the IC card 1, to allow an addition another function to the functions which the IC card 1 has possessed primarily, and the expansion of its function as a whole.

That is to say, in this embodiment, adaptor module 18 has, for example, a telephone function including a speaker function and a microphone function, as another prescribed function different from the function which the IC card 1 has possessed (i.e. the IC card module 8 has possessed) primarily.

Figure 7:
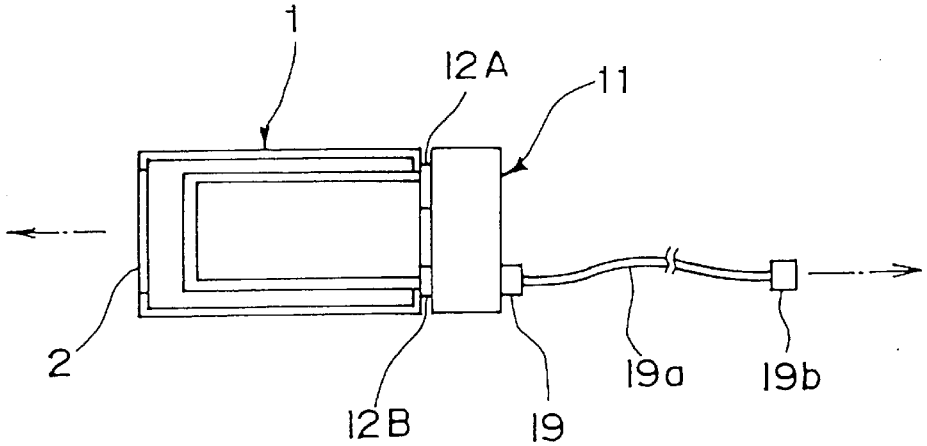
FIG. 7 is a plan view illustrates the connecting condition of the IC card and the IC card adaptor in the first embodiment of the invention.

Therefore, as shown in FIG. 7, after inserting the main-connector 2 of the IC card 1 into the card slot of the personal computer (not shown), and connecting the adaptor 11 to the rear side(to the side provided with the sub-connectors 12A, 12B), also, after connecting a connector 19 with a cable to the sub-connector 13 of the adaptor 11, by connecting a connector 19*b* provided at another end of the cable 19*a* of connector 19 to a public circuit, a data communication by the personal computer through the public circuit comes to be available, at the same time, it comes to be possible to use the personal computer as a telephone set. In such a condition, the electronic components etc.17 on the electric circuit board 16 of the adaptor 11 are driven by electrical power supplied from the IC card 1.

On the other hand, when the conventional functions of the IC card 1 are utilized, only the IC card may be used, without connecting the adaptor 11 thereinto.

As explained in the above, in this embodiment of IC card adaptor 11 according to the invention, it has the adaptor module 18 constituted by connecting both of the primary and the secondary connectors 12A, 12B and 13 to the electric circuit board 16 incorporated with the prescribed electronic components etc. 17, and the adaptor module 18 has the telephone function as another prescribed function different from the functions which the IC card 1 has possessed(the telecommunication function with outer public circuits and the telecommunication function with portable telephones), therefore, by connecting the primary connectors 12A, 12B to the sub-connectors 3A, 3B of the IC card 1, it is possible to add another prescribed function to the primary functions the IC card 1.

Accordingly, in adding another prescribed function to the primary functions of the IC card 1 has possessed primarily, the users need not purchase a new IC card incorporated with all of those functions, and can expand or elevate the functions of the IC card 1 only by purchasing a relatively inexpensive adaptor 11.

Next, a second embodiment of the invention, illustrated in FIG. 8 and FIG. 9, will be explained.

Figure 8:
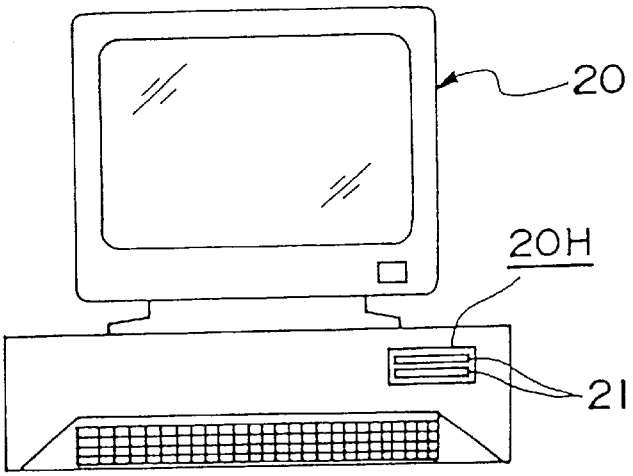
FIG. 8 is a front view of the personal computer in a second embodiment of the present invention.

In FIG. 8, for example, a personal computer 20 is shown, as a computer equipment in which an IC card 21 is used by being inserted, and this personal computer 20 has a card receiver 20H into which a plurality of(for example two; in this embodiment) IC cards 21 can be inserted. The basic construction and mechanism of each card 21 are the same as those in the above-mentioned first embodiment.

Figure 9:
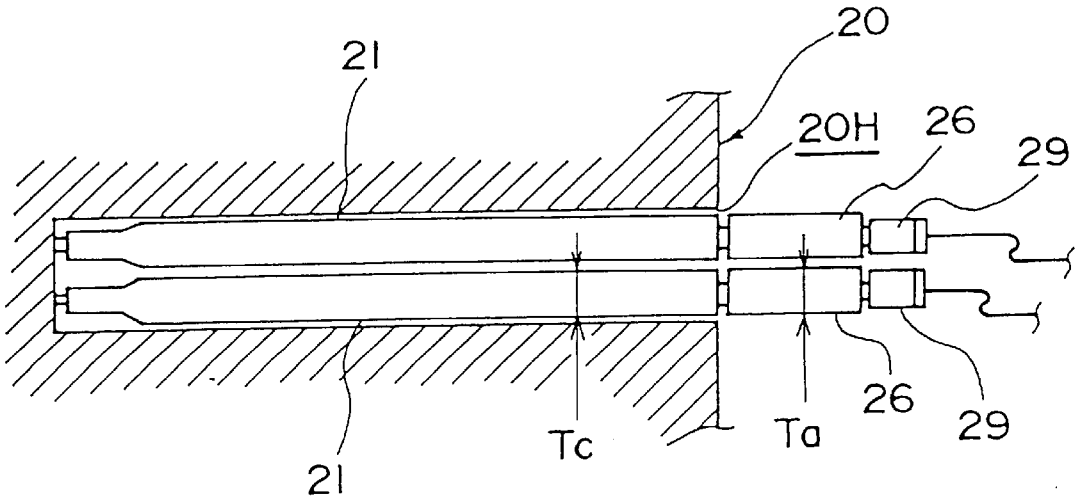
FIG. 9 is a vertical cross-sectional view illustrates the IC card in mounted condition in the second embodiment of the invention.

As shown in FIG. 9, an IC card adaptor 26 in this embodiment is formed not to be thicker than the IC card 21, so that it can be connected to each IC card 21 without hindrance, even if a plurality of (two) IC cards 21 are inserted into the card receiver 20H.

In other words, the thickness Ta of the adaptor 26 is nearly equal or, more preferably, less than the maximum thickness Tc of the IC card 21 ($Ta \leqq Tc$).

Each adaptor 26 has basically the same construction and mechanism as in the above-mentioned first embodiment, and, to its rear portion, connectors 29 with cables which interface the adaptor 21 to e.g. a public circuit or another computer are connected respectively.

In the case of such an adaptor 26, since it has the adaptor module inserted with the electronic components etc. in it, its thickness tends to be greater than in normal adapters, but, in the case of the adaptor 26 in the embodiment, by using thin type electronic components etc., in particular, with regard to comparatively large size components such as transducer etc., reducing the thickness of the adaptor 26, as a whole, can be achieved.

Accordingly, since the thickness of the IC card adaptor is equal or less than a maximum thickness of the IC card, in the case that a card receiver 2H having a plurality of card slots are provided on the body of the electronic equipment(the personal computer 20) to be mounted with the IC card 21, it is possible to connect the adapters 26 to the IC cards 21 inserted into the plurality of the card slots respectively, without interfering with each other.

Especially, in the case that each adaptor 26 is to add another function which the IC card 1 does not have primarily, as same as in the first embodiment, it is possible to use the conventional IC card receiver 20H of the personal computer 20 without any trouble, and to expand or improve functions of the IC card system inexpensively.

Next, a third embodiment of the invention, illustrated in FIG. 10–FIG. 12, will be explained.

Figure 10:
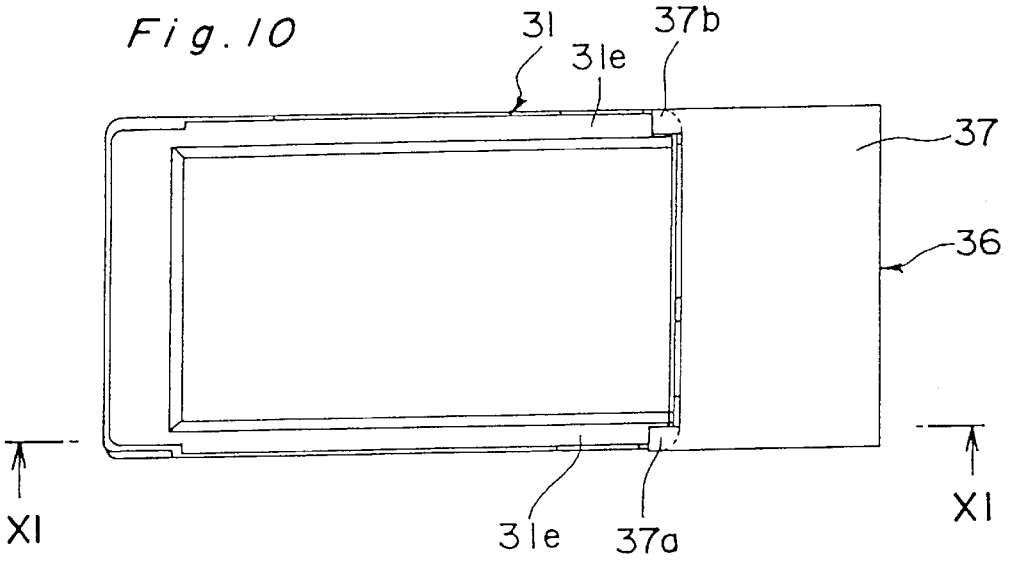
FIG. 10 is a plan view illustrates the connecting condition of IC card and IC card adaptor in a third embodiment of the invention.
Figure 11:
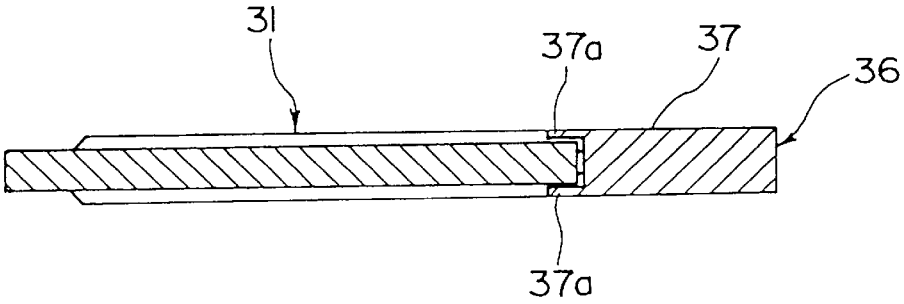
FIG. 11 is a cross-sectional view illustrates schematically the vertical cross-section of FIG. 10 as taken along line XI—XI.

As shown in FIG. 10 and FIG. 11, in an IC card adaptor 36 of this embodiment, a pair of cover portions 37*a*, 37*b* which sandwich, from an upper and lower sides, left and right corners of a rear end portion of an IC card 31 are provided in a case 37 which forms an outer shape of the IC card adapter. Those cover portions 37*a*, 37*b* are formed by expanding the parts of the adapter case 37 in a connecting direction, wherein the parts are corresponding to the left and right corners of the rear end portion of the IC card, in the connecting direction, and they are provided to an obverse and reverse of the adaptor case 37 respectively.

Figure 12:
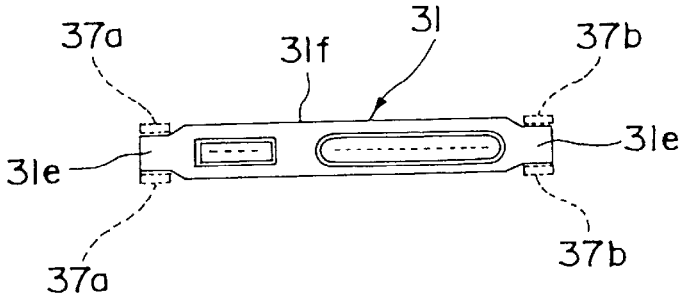
FIG. 12 is a side view illustrates the sub-connector of the IC card in the third embodiment of the present invention.

IC card 31 is, as understood well from FIG. 12, formed so that both of the left and right side edge portions 31*e* are thinner than the flat portion 31*f* therebetween. Such a configuration of the IC card 31 is a common one as an IC card. Also, the basic construction and mechanism of the IC card 31 are same as those in the above-mentioned first embodiment. Further, with regard to the adaptor 36, more preferably, its basic construction and mechanism are same as those in the above-mentioned first embodiment.

And, when the adaptor 36 is connected to the IC card 31, the cover portions 37*a*, 37*b* of the adaptor case 37 fit, by sandwiching from the upper and lower side, with the rear end portions of the left and right side edge portions 31*e* of the IC card 31, and hold the portions.

Therefore, when an external force acts on the adaptor 36 in an upper and lower direction when connected to the IC card 31, a moment load caused by the external force is endured by the fitting portions between the cover portions 37*a*, 37*b* of the adaptor 36 and the rear end portions of the left and right side edge portions 31*e* of the IC card 31, and, it does not act directly on the connecting portion between the connectors of the adaptor 36 and the IC card 31. Therefore, it is possible to improve the reliability of the contact between the connectors.

In other words, even if an external force acts on the adaptor 36 in an upper and lower direction when connected to the IC card 31, the influence on the connecting portion between the connectors of the adaptor and the IC card can be reduced, and, the reliability of IC card system when it is used by connecting both connectors each other can be further improved.

Next, the fourth embodiment of the invention, illustrated in FIG. 13–FIG. 15, will be explained.

Figure 13:
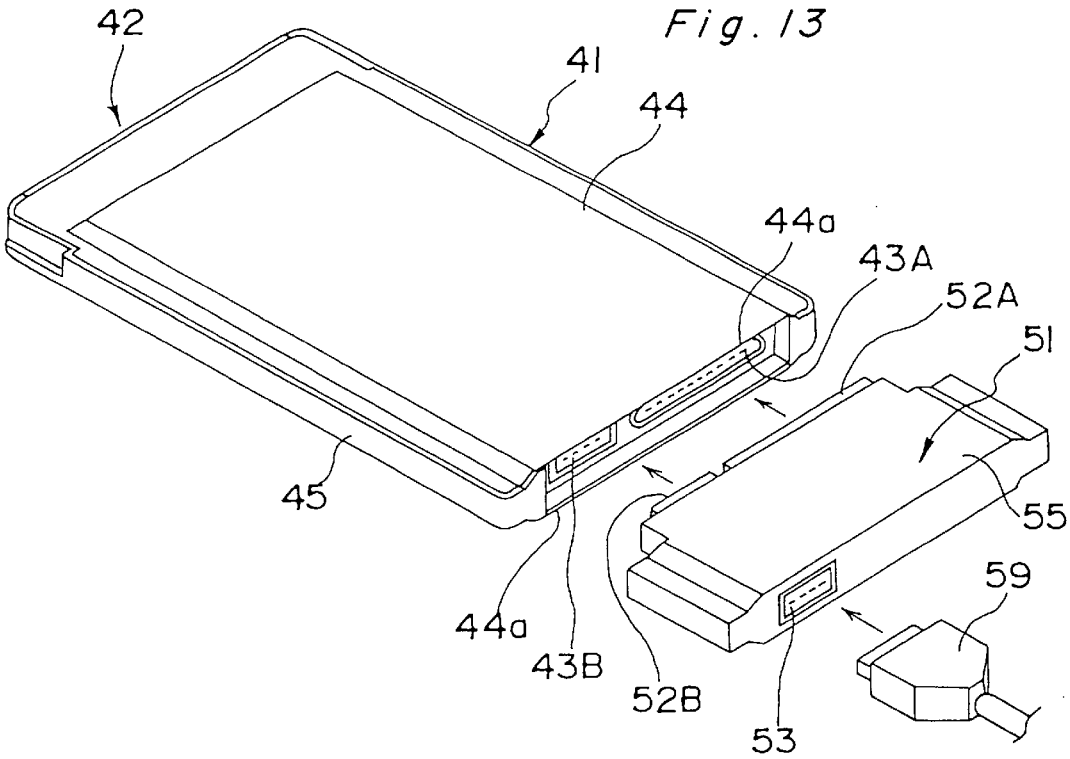
FIG. 13 is a perspective view of the IC card and the IC card adaptor in a fourth embodiment of the present invention.
Figure 14:
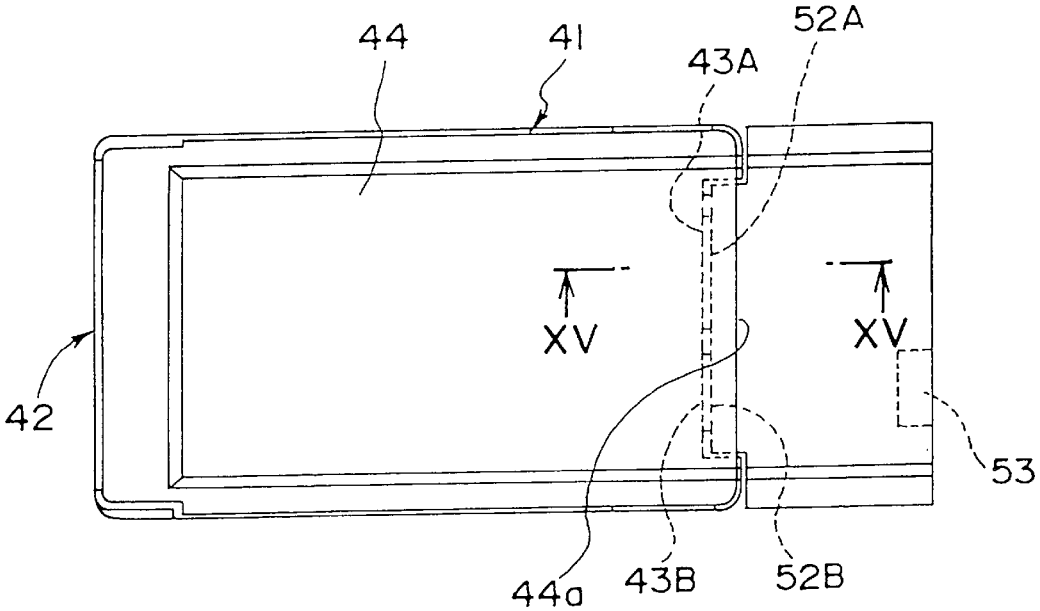
FIG. 14 is a plan view illustrates the connecting condition of the IC card and the IC card adaptor in the fourth embodiment of the invention.
Figure 15:
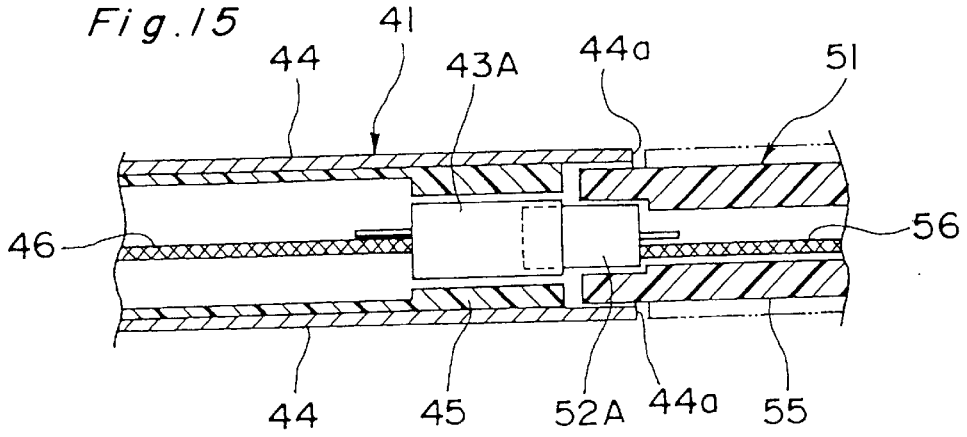
FIG. 15 is a vertical cross-sectional view of FIG. 14 as taken along line XV—XV.
Figure 16:
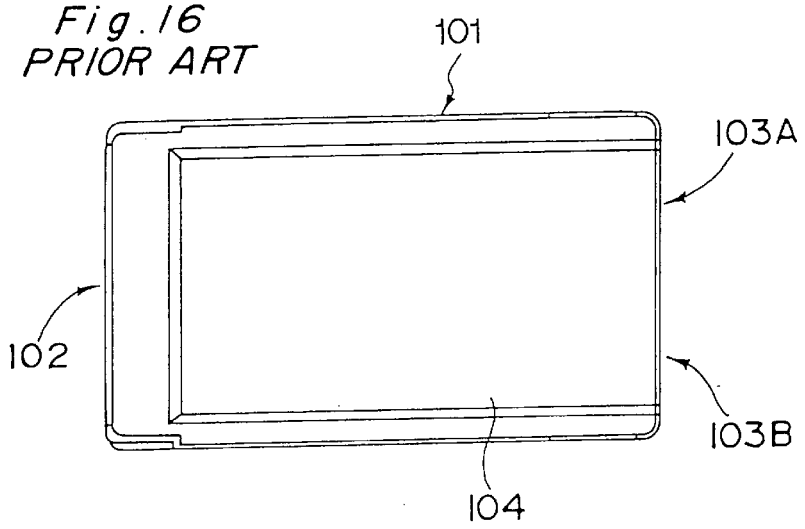
Fig. 16 PRIOR ART
FIG. 16 is a plan view of the conventional IC card.
Figure 17:
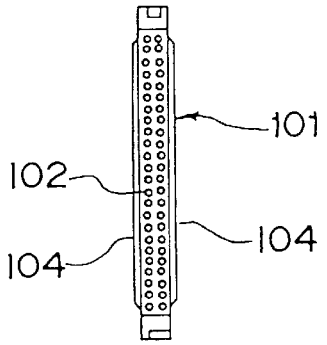
Fig. 17 PRIOR ART
FIG. 17 is a side view illustrates the mainconnector of the conventional IC card.
Figure 18:
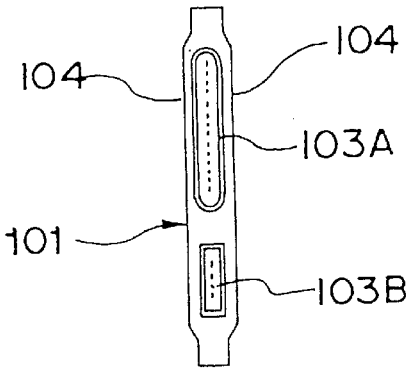
Fig. 18 PRIOR ART
FIG. 18 is a side view illustrates the sub-connector of the conventional IC card.
Figure 19:
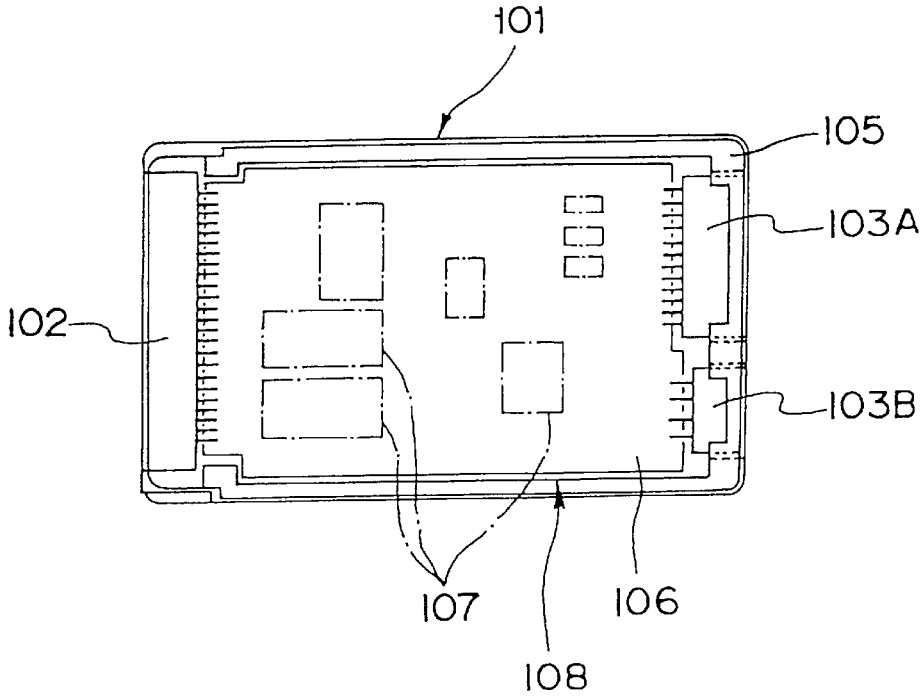
Fig. 19 PRIOR ART
FIG. 19 is a plan view illustrates the inner construction of the conventional IC card.
Figure 23:
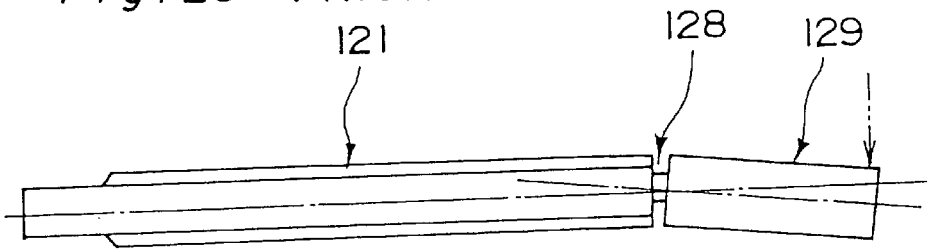
Fig. 23 PRIOR ART
FIG. 23 is a side view illustrates schematically the connecting condition of another conventional IC card and IC card adaptor.
Figure 24:
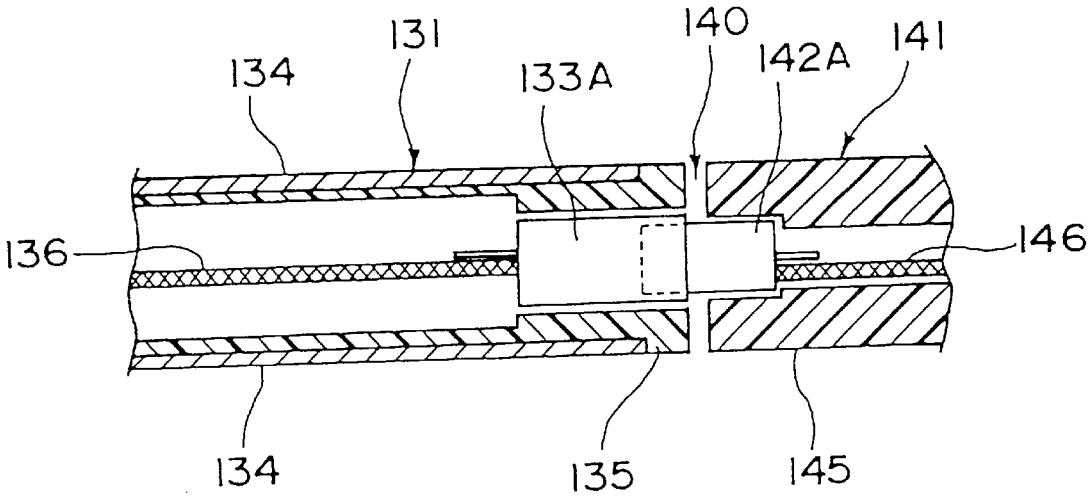
Fig. 24 PRIOR ART
FIG. 24 is an enlarged vertical cross-sectional view illustrates the connecting condition of the other conventional IC card and IC card adaptor.

As shown in FIG. 13–FIG. 15, in an IC card 41 of this embodiment, sub-connectors 43A, 43B provided to a rear portion of the IC card 41 and mounted to an electric circuit board 46 (refer to FIG. 15) are designed, so that the end faces of the connecting portions are to be positioned in inner side of the IC card body 41 than a rear end 44*a* of each metal panel 44 which cover the upper and lower side of a plastic frame 45. On the other hand, the thickness of an IC card adaptor 51 enveloped by a case 55 is determined to be smaller than a distance between the upper and lower metal panel 44 of the IC card 41.

In the IC card 41, the basic construction and mechanism are same as those in the above-mentioned first embodiment except for the positional relationship between the sub-connectors 43A, 43B and each rear end 44*a* of each metal panel 44, and, a main-connector 42 is provided on the front side. Also, with regard to the adaptor 51, more preferably, its basic construction and mechanism are same as those in the above-mentioned first embodiment, and, on its electric circuit board 56 (refer to FIG. 15), primary connectors 52A, 52B to be connected to the sub-connectors 43A, 43B and a secondary connector 53 to which a connector 59 with a cable is connected.

And, when the adaptor 51 is connected to the IC card 41, the connecting portion between the sub-connectors 43A, 43B of the IC card 41 and the primary connectors 52A, 52B of the adaptor 51 is to be positioned in inner side than an end portion of metal panels of the IC card. Therefore, the connecting portion is not exposed directly to the outside through the clearance formed between the end portion of the IC card 41 and the end portion of the adaptor 51.

In other words, the connecting portion between the sub-connectors 43A, 43B of the IC card 41 and the primary connectors 52A, 52B of the adaptor 51 can be protected effectively, and, the reliability of IC card system when it is used by connecting both connectors each other can be further improved.

The embodiment of the invention shown in FIG. 13–FIG. 15, the adaptor 51 is designed so that its overall thickness is smaller than the distance between the upper and lower metal panels 44 of the IC card 41, but, alternatively, with regard to only at least a predetermined end portion including the primary connectors 52A, 52B, its thickness may be smaller than the distance between the upper and lower metal panels 44 of the IC card 41.

The invention is not limited within the foregoing embodiments, and, it is to be understood that the various kind of improvements and the alternation in design is possible in the scope of the invention.

What is claimed is:

1. An IC card adaptor to be connected with an IC card having a main-connector on one side for connecting with a prescribed electronic device and a sub-connector on another side for connecting with said adaptor, said adaptor comprising:

a primary connector to be connected to the sub-connector of the IC card;

a secondary connector to be connected with a telecommunication line directly or through another electronic device; and an electric circuit board on which electronic components are mounted;

wherein said primary connector and said secondary connector are connected to said electric circuit board to form an adaptor module, the adaptor module being provided with circuitry which enables the prescribed electronic device to function as a telephone set.

2. An IC card adaptor according to claim 1, wherein a thickness of said IC card adaptor is equal to or less than a maximum thickness of the IC card.

3. An IC card adaptor to be connected with an IC card having a main-connector on one side for connecting with a prescribed electronic device and a sub-connector on another side for connecting with said adaptor, said adaptor comprises:

a primary connector to be connected to the sub-connector of the IC card;

a secondary connector to be connected with another electronic device or a telecommunication line; and an adaptor case which forms an outer shape of said adaptor, said adaptor case having a pair of upper and lower protruding cover portions which, when said adaptor is connected to the IC card, extend over and fit with predetermined outer portions of the IC card.

* * * * *